US009056323B2

(12) United States Patent
Ji et al.

(10) Patent No.: US 9,056,323 B2
(45) Date of Patent: Jun. 16, 2015

(54) RICH AIR SPRAYER COMPONENT

(71) Applicants: Huasong Zhou, Xiamen, Fujian (CN); XIAMEN SOLEX HIGH-TECH INDUSTRIES CO., LTD., Xiamen, Fujian (CN)

(72) Inventors: Yangfeng Ji, Xiamen (CN); Yurong Yang, Xiamen (CN); Tao Cai, Xiamen (CN); Huasong Zhou, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 53 days.

(21) Appl. No.: 13/899,797

(22) Filed: May 22, 2013

(65) Prior Publication Data

US 2013/0320113 A1 Dec. 5, 2013

(30) Foreign Application Priority Data

Jun. 4, 2012 (CN) ..... 2012 1 0181497

(51) Int. Cl.

| | |
|---|---|
| ***E03C 1/084*** | (2006.01) |
| ***B05B 1/18*** | (2006.01) |
| ***B05B 7/04*** | (2006.01) |
| ***B05B 7/00*** | (2006.01) |

(52) U.S. Cl.

CPC ..... *B05B 7/0425* (2013.01); *E03C 1/084* (2013.01); *B05B 1/18* (2013.01)

(58) Field of Classification Search

CPC ..... E03C 1/084; B05B 7/005; B05B 7/0425; B05B 1/18; Y10S 261/22

USPC ..... 239/8, 398, 419.5, 428.5, 429, 430, 239/431, 432, 589, 590.3, 590.5, 594; 137/888

See application file for complete search history.

(56) References Cited

U.S. PATENT DOCUMENTS

| | | | | |
|---|---|---|---|---|
| 578,948 | A * | 3/1897 | Schaffstaett | 239/428.5 |
| 2003/0029935 | A1 * | 2/2003 | Takeshi et al. | 239/428.5 |
| 2011/0240767 | A1 * | 10/2011 | Kitaura et al. | 239/428.5 |

* cited by examiner

*Primary Examiner* — Darren W Gorman
(74) *Attorney, Agent, or Firm* — Rabin & Berdo, P.C.

(57) ABSTRACT

The present invention is provided with a rich air sprayer component, which is disposed with a fixation part. The fixation part is disposed with an inlet part and an air enriching part. The inlet part is disposed with at least an inlet hole; the air enriching part is disposed with an air hole; the sectional area of the cavity of the air enriching part is larger than the sectional area of the inlet hole, making that negative pressure generates when water flows into the air enriching part from the inlet hole and air gets in from outside, air and water flow mix to form gas-water mixture, the sectional area of the cavity of the air enriching part is gradually narrowed, so that the gas-water mixture is dashed on the inner wall of the air enriching part to make water flow drawn air enough. It has advantages as below: the gas-water mixture is rich in air, making the sprayer with water saving, of granular sensation and strong spraying force.

7 Claims, 5 Drawing Sheets

RICH AIR SPRAYER COMPONENT

FIELD OF THE INVENTION

The present invention relates to a rich air sprayer component.

BACKGROUND OF THE INVENTION

There are kinds of showers with different water type, such as the bubble water and shower water. People choose the water type and consider the use characteristic of the water type and the water saving effect. To satisfy user's needs, there is a spraying water outlet mechanism loved by many people, which is not only provided with splash water but also water saving. For example, a sprayer of sanitary ware is disclosed in the Chinese patent database with announcement number CN100553789C. it's provided with a independent nozzle body, which is disposed with an opening of step shaped, the longitudinal axis of the opening is inclined to the symmetry axis of the independent nozzle body and expanded. The independent nozzle body is further disposed with a mixing cavity, which comprising a contraction part narrowed along the diameter direction. The contraction part is disposed with a step part. This kind of structure is disposed to form splash, but the splash is low in spraying force and granular sensation. The splash type is disordered and the shower effect is not good.

SUMMARY OF THE INVENTION

The present invention is provided with a rich air sprayer component, which overcomes the disadvantages of the existing technology. The technical proposal of the present invention to solve the technical problem is as below:

A rich air sprayer component comprising a fixation part (100), which is disposed with an inlet part (200) and an air enriching part (300) below the inlet part (200); the inlet part (200) is disposed with at least an inlet hole (210); the air enriching part (300) is disposed with an air hole (310); the sectional area of the cavity of the air enriching part (300) is larger than the sectional area of the inlet hole (210), making that negative pressure generates when water flows into the air enriching part (300) from the inlet hole (210) and air gets in from outside, air and water flow mix to form gas-water mixture, the sectional area of the cavity of the air enriching part (300) is gradually narrowed, so that the gas-water mixture is dashed on the inner wall of the air enriching part (300) to make water flow drawn air enough.

In another preferred embodiment, the fixation part (100) further comprising an adjusting part (400) below the air enriching part (300), the adjusting part (400) is disposed with an outlet (410) connected to the inlet hole (210), the sectional area of cavity of the adjusting part (400) is gradually expanded.

In another preferred embodiment, the air enriching part (300) and the adjusting part (400) are one step formed.

In another preferred embodiment, the wall of the cavity of the air enriching part (300) and the adjusting part (400) is curved.

In another preferred embodiment, the sectional area of the cavity of the air enriching part (300) and the adjusting part (400) is circular shaped.

In another preferred embodiment, the flare angle of the outlet (410) is ranged from 25 degrees to 45 degrees.

In another preferred embodiment, the wall of the cavity of the air enriching part (300) is disposed with several spaced projections (320), the air hole (310) is disposed on the top surface of the projection (320).

In another preferred embodiment, the number of the projections (320) is six and the six projections (320) are spaced and circularly arranged, the number of the inlet hole (210) is six and six inlet holes (210) are spaced and circularly arranged, six inlet holes (210) are alternately arranged with the six projections (320).

Compared to the existing technology, the technical proposal of the present invention has advantages as below:

1. The sectional area of the cavity of the air enriching part is larger than the sectional area of the inlet hole, making that negative pressure generates when water flows into the air enriching part from the inlet hole and air gets in from outside. Air and water flow mix to form gas-water mixture, the sectional area of the cavity of the air enriching part is gradually narrowed, so that the gas-water mixture is dashed on the inner wall of the air enriching part to make water flow drawn air enough, the gas-water mixture is rich in air, making the sprayer with water saving, of granular sensation and strong spraying force.

2. The sectional area of the cavity of the adjusting part is gradually expanded, making it with well splashing effect and better experience.

3. The wall of the cavity of the air enriching part and the adjusting part is curved, the gas-water mixing effect is well, the splash is better, the granular sensation is better, and the shower effect is better as well.

4. The sectional area of the cavity of the air enriching part and the adjusting part is circular shape, the gas-water mixing effect is better and it is with great look.

5. The flare angle of the outlet is ranged from 25 degrees to 45 degrees, making the splash strength and the granular sensation more close to the needs of the user; it's more comfortable with well experience.

6. The air enriching part is disposed with some projections, preventing water flowing out of the air hole, the design is ingenious.

7. The inlet holes and the projections are alternately arranged, preventing water flowing out of the air hole.

BRIEF DESCRIPTION OF THE DRAWINGS

The present invention will be further described with drawings and embodiments.

DETAILED DESCRIPTION OF THE EMBODIMENT

Figure 1:
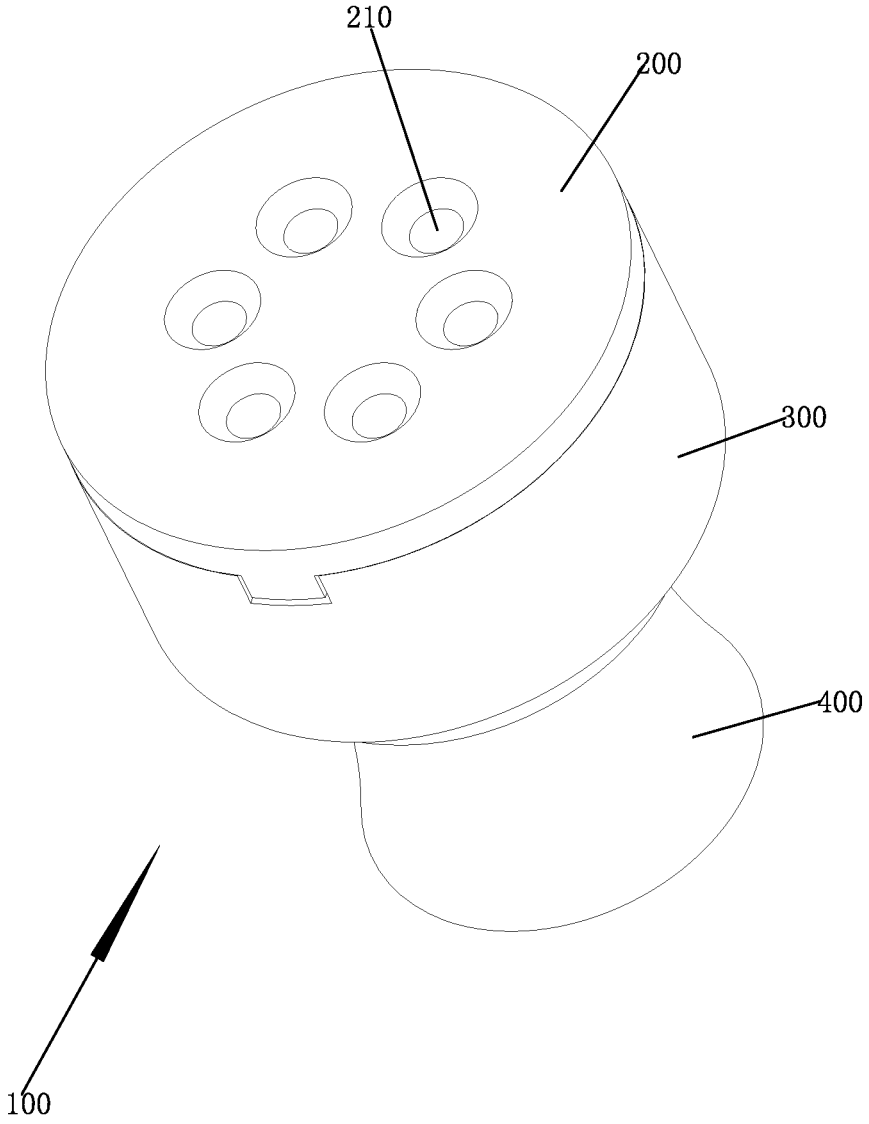
FIG. 1 illustrates the structure of a rich air sprayer component of a preferred embodiment of the present invention.
Figure 2:
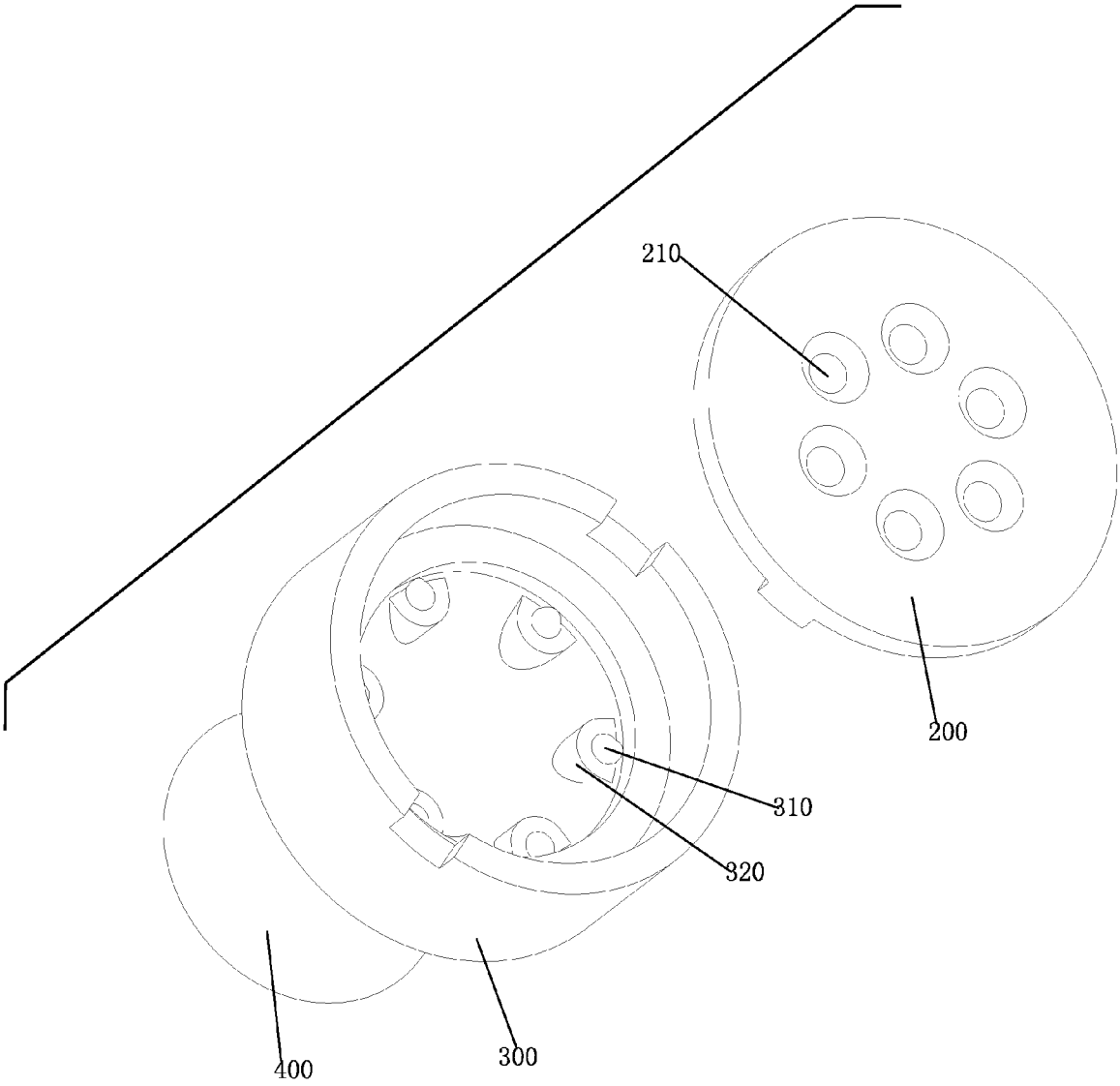
FIG. 2 illustrates the breakdown structure of a rich air sprayer component of a preferred embodiment of the present invention.
Figure 3:
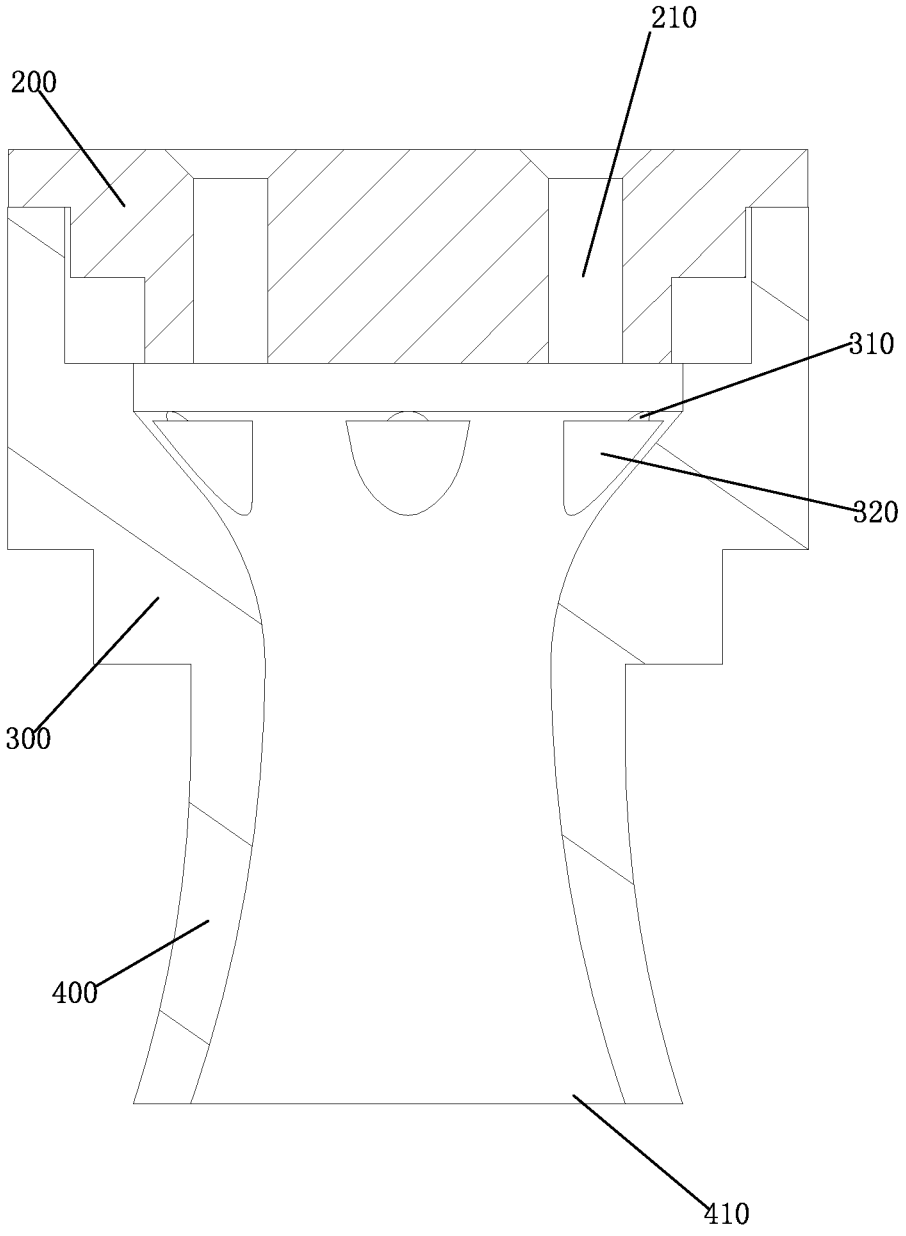
FIG. 3 illustrates the sectional view of a rich air sprayer component of a preferred embodiment of the present invention.
Figure 4:
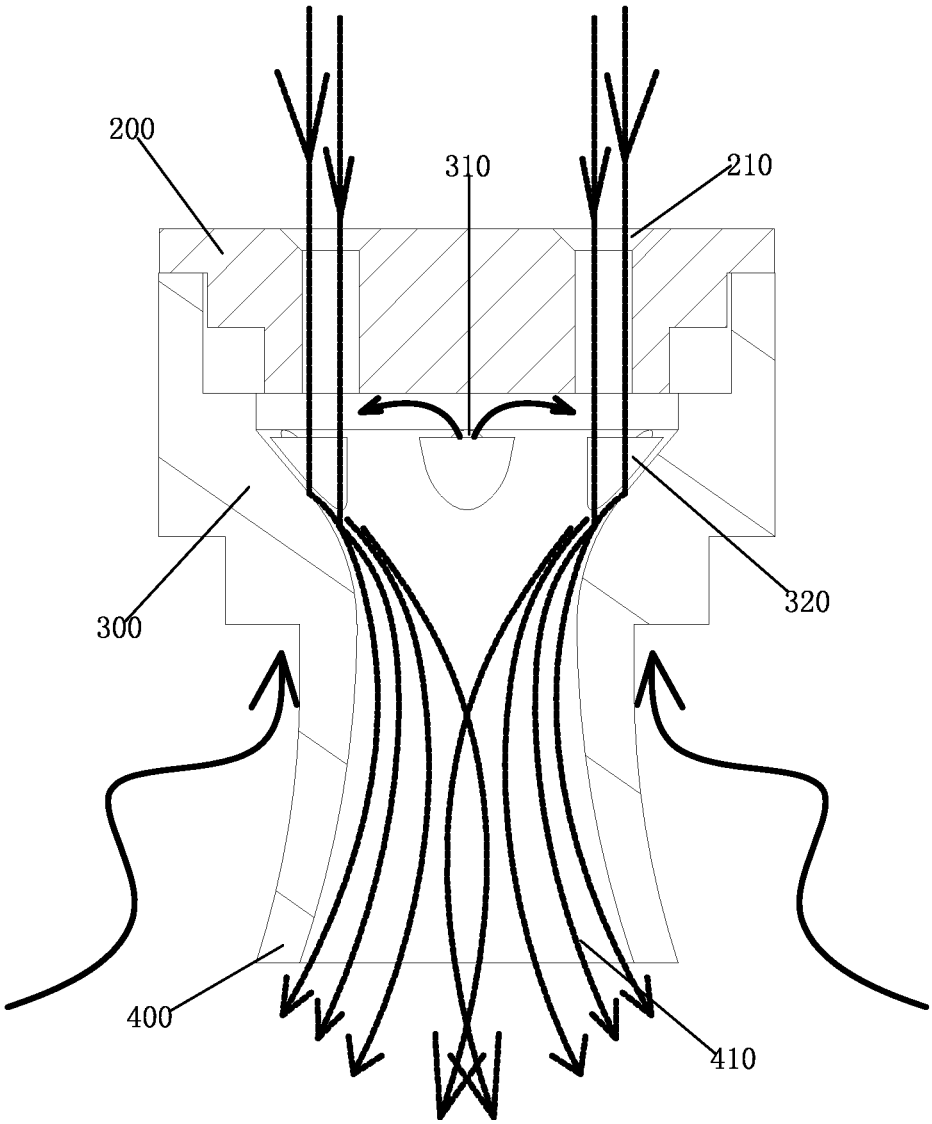
FIG. 4 illustrates the sectional view of a rich air sprayer component of a preferred embodiment of the present invention in working state.
Figure 5:
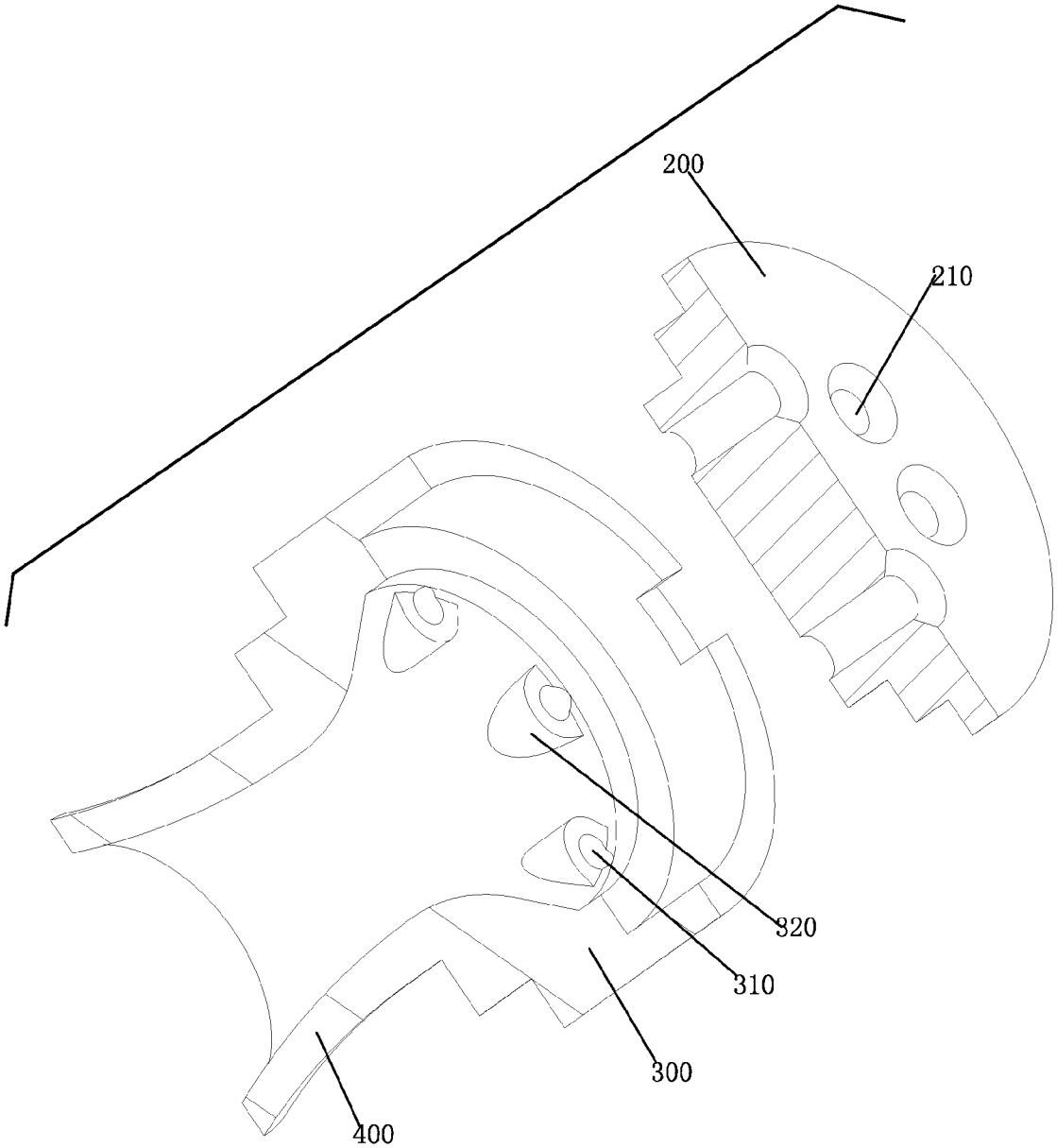
FIG. 5 illustrates the sectional view of the breakdown structure of a rich air sprayer component of a preferred embodiment of the present invention.

Please refer to FIG. 1 to FIG. 5. A rich air sprayer component of a preferred embodiment of the present invention is disposed with a fixation part 100.

The fixation part 100 is disposed with an inlet part 200 and an air enriching part 300 below the inlet part 200, the inlet part 200 is covered on the air enriching part 300.

The inlet part 200 is disposed with at least an inlet hole 210. In this embodiment, there are six inlet holes 210 spaced and circularly arranged.

The air enriching part 300 is disposed with an air hole 310. The sectional area of the cavity of the air enriching part 300 is larger than the sectional area of the inlet hole 210, making that negative pressure generates when water flows into the air enriching part 300 from the inlet hole 210 and air gets in from outside. Air and water flow mix to form gas-water mixture, the sectional area of the cavity of the air enriching part 300 is gradually narrowed, so that the gas-water mixture is dashed on the inner wall of the air enriching part 300 to make water flow drawn air enough, the gas-water mixture is rich in air, making the sprayer with water saving, of granular sensation and strong spraying force. In this embodiment, the wall of the cavity of the air enriching part 300 is disposed with several spaced projections 320, the air hole 310 is disposed at the top surface of the projection 320. Preferred, there are six projections 320 spaced and circularly arranged, the inlet holes 210 and the projections 320 are alternately arranged. The projections 320 prevent water flowing out of the air hole 210, the design is ingenious.

The fixation part 100 is further disposed with an adjusting part 400 below the air enriching part 300. The adjusting part 400 is disposed with an outlet 410 connected to the inlet hole 210, and the sectional area of the cavity of the adjusting part 400 is gradually expanded. This kind of design makes it with well splashing effect and better user experience. In this embodiment, the air enriching part 300 and the adjusting part 400 are one step forming. Preferred, the flare angle of the outlet 410 is ranged from 25 degrees to 45 degrees, making the splash strength and the granular sensation more close to the needs of the user; it's more comfortable with well experience. In another situation, the flare angle can be adjusted according to different user's needs to therefore satisfy.

In this embodiment, the wall of the cavity of the air enriching part 300 and the adjusting part 400 are is curved, so that the gas-water mixing effect is well, the splash is better, the granular sensation is better, and the shower effect is better as well.

Preferred, the sectional area of the air enriching part 300 and the adjusting part 400 is circular shaped, so that the gas-water mixing effect is better and it is with great look. The splash of the rich air sprayer component is rich in air, strong spraying force, well granular sensation and good look, it can be widely applied in shower, kitchen shower, tap or other outlet terminals, such as the car windshield, but not limited to these.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A rich air sprayer component, comprising:

a fixation part having an inlet part and an air enriching part below the inlet part, the inlet part having an inlet hole, the air enriching part having an air hole, a sectional area of a cavity of the air enriching part is larger than a sectional area of the inlet hole so that negative pressure is generated when water flows into the air enriching part from the inlet hole and air gets into the air enriching part from an outside such that the air and the water mix to form a gas-water mixture, the sectional area of the cavity of the air enriching part gradually narrowing so that the gas-water mixture is dashed on an inner wall of the air enriching part to further enrich the gas-water mixture with the air, wherein the wall of the air enriching part, which is a wall of the cavity, has a plurality of spaced projections, the air hole is disposed on a top surface of one of the projections.

2. A rich air sprayer component according to claim 1, wherein the fixation part further comprises an adjusting part below the air enriching part, the adjusting part has an outlet connected to the inlet hole, a sectional area of a cavity of the adjusting part gradually expanding.

3. A rich air sprayer component according to claim 2, wherein the air enriching part and the adjusting part are one step formed.

4. A rich air sprayer component according to claim 2, wherein each of the wall of the cavity of the air enriching part and a wall of the adjusting part is curved.

5. A rich air sprayer component according to claim 4, wherein each of the sectional area of the cavity of the air enriching part and the sectional area of the adjusting part is circular shaped.

6. A rich air sprayer component according to claim 2, wherein a flare angle of the outlet is in a range from 25 degrees to 45 degrees.

7. A rich air sprayer component according to claim 1, wherein a number of the projections is six, and the six projections are spaced and circularly arranged, further wherein the inlet hole includes six inlet holes, and the six inlet holes are spaced and circularly arranged, the six inlet holes are arranged relative to the six projections to reduce water from flowing out of the inlet holes.

* * * * *